US008754017B2

(12) United States Patent
Carrick et al.

(10) Patent No.: US 8,754,017 B2
(45) Date of Patent: Jun. 17, 2014

(54) LUBRICANT FOR NATURAL GAS ENGINES

(75) Inventors: Virginia A. Carrick, Chardon, OH (US); Mayur Shah, Hudson, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 13/003,774

(22) PCT Filed: Jul. 13, 2009

(86) PCT No.: PCT/US2009/050377
§ 371 (c)(1),
(2), (4) Date: Feb. 10, 2011

(87) PCT Pub. No.: WO2010/009036
PCT Pub. Date: Jan. 21, 2010

(65) Prior Publication Data

US 2011/0160106 A1 Jun. 30, 2011

Related U.S. Application Data

(60) Provisional application No. 61/081,061, filed on Jul. 16, 2008.

(51) Int. Cl.
*C10M 159/24* (2006.01)
*C10M 141/10* (2006.01)

(52) U.S. Cl.
USPC ..... 508/391; 508/287; 508/372; 508/373

(58) Field of Classification Search
USPC ..... 508/391
See application file for complete search history.

(56) References Cited

U.S. PATENT DOCUMENTS

| | | | | |
|---|---|---|---|---|
| 2,501,731 | A | 3/1950 | Mertes | |
| 5,037,565 | A | 8/1991 | King | |
| 5,726,133 | A | 3/1998 | Blahey et al. | |
| 6,191,081 | B1 * | 2/2001 | Cartwright et al. | 508/460 |
| 6,596,672 | B1 * | 7/2003 | Carrick et al. | 508/192 |
| 6,613,724 | B2 * | 9/2003 | Strickland et al. | 508/460 |
| 6,642,191 | B2 * | 11/2003 | Palazzotto et al. | 508/501 |
| 6,645,923 | B2 * | 11/2003 | Dunn et al. | 508/460 |
| 6,727,208 | B2 | 4/2004 | Wilk | |
| 6,787,509 | B2 | 9/2004 | Chambard et al. | |
| 7,166,562 | B2 | 1/2007 | Blahey et al. | |
| 7,183,241 | B2 * | 2/2007 | Cartwright | 508/363 |
| 7,772,169 | B2 * | 8/2010 | Barnes et al. | 508/291 |
| 8,071,518 | B2 * | 12/2011 | Yagishita et al. | 508/469 |
| 8,288,326 | B2 * | 10/2012 | Tobias et al. | 508/287 |
| 8,383,563 | B2 * | 2/2013 | Poirier et al. | 508/526 |
| 2005/0054543 | A1 * | 3/2005 | Cartwright | 508/376 |
| 2005/0070447 | A1 * | 3/2005 | Barnes et al. | 508/291 |
| 2006/0052256 | A1 | 3/2006 | Barnes et al. | |
| 2007/0129263 | A1 * | 6/2007 | Boffa et al. | 508/192 |
| 2007/0142239 | A1 * | 6/2007 | Boffa et al. | 508/192 |
| 2008/0269089 | A1 * | 10/2008 | Cartwright | 508/371 |
| 2011/0053814 | A1 * | 3/2011 | Tobias et al. | 508/287 |
| 2011/0245121 | A1 * | 10/2011 | Tobias et al. | 508/291 |

FOREIGN PATENT DOCUMENTS

| | | |
|---|---|---|
| CN | 1523088 A | 8/2004 |
| WO | 89/04358 | 5/1989 |
| WO | 03/064570 | 8/2003 |
| WO | 03/099962 | 12/2003 |
| WO | 2006/060255 | 6/2006 |

OTHER PUBLICATIONS

Search Report from corresponding PCT Application No. PCT/US2009/050377 dated Mar. 5, 2010.
Written Opinion from corresponding PCT Application No. 2009/050377 dated Mar. 5, 2010.
CN1523008A Machine Translation, Petrochina Co., Ltd., published Aug. 25, 2004.
Abstract of CN1523008A, Espacenet Worldwide Database.

* cited by examiner

*Primary Examiner* — Ellen McAvoy
(74) *Attorney, Agent, or Firm* — David M. Shold, Esq.; Michael F. Esposito, Esq.

(57) ABSTRACT

An engine fueled by natural gas may be lubricated by providing thereto a lubricant composition of an oil of lubricating viscosity, an overbased monovalent metal detergent in an amount to provide at least about 0.01 weight percent monovalent metal to the lubricant composition, wherein the monovalent metal comprises about 10 to about 30 percent by weight of the total metal content of the lubricant composition, an overbased divalent metal detergent, in an amount to provide at least about 0.005 percent by weight of the divalent metal to the lubricant composition, a dispersant, and a metal salt of a phosphorus acid. The lubricant composition has a sulfated ash of less than about 0.8 percent.

11 Claims, No Drawings

LUBRICANT FOR NATURAL GAS ENGINES

BACKGROUND OF THE INVENTION

The present invention relates to lubricating oil compositions which provide high performance standards particularly in natural gas engines.

There is continuous need for improving the performance characteristics of engines, in particular natural gas engines, including stationary gas engines and engines consuming compressed natural gas, and the lubricating oils used therein. Stationary gas engines are typically large, heavy duty, stationary engines designed to run on natural gas and other like fuels. Trends in such engines include the development of smaller four-cycle, lean burning engines, for which high performance lubricants are important.

Acceptable performance in natural gas engines requires that the lubricant maintain its good qualities in spite of the severe conditions under which the engines may operate. Various forms of deterioration of the lubricant may result from contact with acidic or corrosive gaseous products of combustion. Despite such challenges, the lubricant should exhibit low degrees of oxidation and nitration over time. Likewise, it is important that the development of acidity in the lubricant be minimized. Acidity is typically measured and reported in terms of Total Acid Number ("TAN"), ASTM D664A. In order to mitigate acidity formation, many lubricant formulations include basic compounds such as overbased detergents, which provide basicity or base reserve to the lubricant, typically measured and reported in terms of Total Base Number ("TBN"), ASTM D2896.

Lubricants containing a variety of detergents are known. For example, U.S. Pat. No. 6,727,208, Wilk, Apr. 27, 2004, discloses a lubricating oil composition comprising a major amount of an oil of lubricating viscosity and an additive system comprising (in addition to other components) from about 0.1 to about 5% by weight of a detergent composition comprising at least two metal overbased compositions wherein said detergent composition consists essentially of (A-1) at least one alkali metal overbased detergent and (A-2) at least one calcium overbased detergent, in certain defined ratios.

U.S. Pat. No. 5,726,133, Blahey et al., Mar. 10, 1998 is directed to a low ash natural gas engine oil which contains an additive package including a particular combination of detergents and also containing other standard additives such as dispersants, antioxidants, antiwear agents, metal deactivators, antifoamants and pour point depressants and viscosity index improvers. The low ash natural gas engine oil exhibits reduced deposit formation and enhanced resistance to oil oxidation and nitration. The mixture of detergents comprises at least one first alkali or alkaline earth metal salt of mixture thereof of low TBN of about 250 and less and at least one second alkali or alkaline earth metal salt or mixture thereof which is more neutral than the first low TBN salt. The metal salts may be based preferably on sodium, magnesium or calcium, and may exist as phenates, sulfonates, or salicylates. More preferably, the metal salts will be calcium phenates, calcium sulphonates, calcium salicylates and mixtures thereof.

U.S. Pat. No. 6,596,672, Carrick et al., Jul. 22, 2003, discloses low ash lubricant compositions containing multiple overbased materials and multiple antioxidants, useful in lubricating stationary gas internal combustion engines. The total sulfated ash content may be about 0.1 percent to about 0.8 percent, A calcium, barium, or strontium overbased acidic material may contribute 0.01 to 0.79 percent sulfated ash, and a magnesium or sodium overbased acidic material may contribute 0.01 to 0.79 percent sulfated ash. In an example, a concentrate for a lubricating composition is prepared by combining a lubricating oil, 14% barium synthetic sulfonate of 400 TBN (oil free), 8% sodium synthetic sulfonate of 150 TBN (oil free), 6% of a succinimide dispersant, and other components.

The disclosed technology, therefore, provides a lubricant for a natural gas engine which exhibits at least one of retention of TBN, reduction of TAN formation, reduced copper corrosion, reduced oxidation, and reduced nitration, by the defined use of an overbased alkali metal detergent.

SUMMARY OF THE INVENTION

The disclosed technology provides a method for lubricating an engine fueled by natural gas, comprising thereto a lubricant composition comprising:

(a) an oil of lubricating viscosity, (b) an overbased monovalent metal detergent, in an amount to provide at least about 0.01 weight percent monovalent metal to the lubricant composition and wherein the monovalent metal comprises about 10 to about 30 percent by weight of the total metal content of the lubricant composition, (c) an overbased divalent metal detergent, in an amount to provide at least about 0.005 percent by weight of the divalent metal to the lubricant composition, (d) a dispersant, and (e) a metal salt of a phosphorus acid;

wherein the lubricant composition has a sulfated ash of less than about 0.8 percent and wherein the overbased monovalent detergent contributes about 10 to about 30 percent of the total sulfated ash of the composition.

DETAILED DESCRIPTION OF THE INVENTION

Various preferred features and embodiments will be described below by way of non-limiting illustration.

One component of the present invention is an oil of lubricating viscosity, The oil may be selected from any of the base oils in Groups I-V as specified in the American Petroleum Institute (API) Base Oil Interchangeability Guidelines. The five base oil groups are as follows:

| Base Oil Category | Sulfur (%) | | Saturates (%) | Viscosity Index |
|---|---|---|---|---|
| Group I | >0.03 | and/or | <90 | 80 to 120 |
| Group II | <0.03 | and | >90 | 80 to 120 |
| Group III | <0.03 | and | >90 | >120 |
| Group IV | All polyalphaolefins (PAOs) | | | |
| Group V | All others not included in Groups I, II, III or IV | | | |

Groups I, II and III are mineral oil base stocks. The oil of lubricating viscosity, then, can include natural or synthetic lubricating oils and mixtures thereof. Mixture of mineral oil and synthetic oils, particularly polyalphaolefin oils and polyester oils, are often used.

Natural oils include animal oils and vegetable oils (e.g. castor oil, lard oil and other vegetable acid esters) as well as mineral lubricating oils such as liquid petroleum oils and solvent-treated or acid treated mineral lubricating oils of the paraffinic, naphthenic or mixed paraffinic-naphthenic types. Hydrotreated or hydrocracked oils are included within the scope of useful oils of lubricating viscosity.

Oils of lubricating viscosity derived from coal or shale are also useful. Synthetic lubricating oils include hydrocarbon oils and halosubstituted hydrocarbon oils such as polymerized and interpolymerized olefins and mixtures thereof, alkylbenzenes, polyphenyl, (e.g., biphenyls, terphenyls, and alkylated polyphenyls), alkylated diphenyl ethers and alkylated diphenyl sulfides and their derivatives, analogs and homologues thereof. Alkylene oxide polymers and interpolymers and derivatives thereof, and those where terminal hydroxyl groups have been modified by, for example, esterification or etherification, constitute other classes of known synthetic lubricating oils that can be used. Another suitable class of synthetic lubricating oils that can be used comprises the esters of dicarboxylic acids and those made from C5 to C12 monocarboxylic acids and polyols or polyol ethers.

Other synthetic lubricating oils include liquid esters of phosphorus-containing acids, polymeric tetrahydrofurans, silicon-based oils such as the polyalkyl-, polyaryl-, polyalkoxy-, or polyaryloxy-siloxane oils, and silicate oils.

Hydrotreated naphthenic oils are also known and can be used. Synthetic oils may be used, such as those produced by Fischer-Tropsch reactions and typically may be hydroisomerised Fischer-Tropsch hydrocarbons or waxes. In one embodiment oils may be prepared by a Fischer-Tropsch gas-to-liquid synthetic procedure as well as other gas-to-liquid oils.

Unrefined, refined and rerefined oils, either natural or synthetic (as well as mixtures of two or more of any of these) of the type disclosed hereinabove can used in the compositions of the present invention. Unrefined oils are those obtained directly from a natural or synthetic source without further purification treatment. Refined oils are similar to the unrefined oils except they have been further treated in one or more purification steps to improve one or more properties. Rerefined oils are obtained by processes similar to those used to obtain refined oils applied to refined oils which have been already used in service. Such rerefined oils often are additionally processed by techniques directed to removal of spent additives and oil breakdown products.

The lubricant will also contain a plurality of overbased metal detergents, Metal-containing detergents are typically overbased materials, or overbased detergents. Overbased materials, otherwise referred to as overbased or superbased salts, are generally homogeneous Newtonian systems characterized by a metal content in excess of that which would be present for neutralization according to the stoichiometry of the metal and the particular acidic organic compound reacted with the metal. The overbased materials are prepared by reacting an acidic material (typically an inorganic acid or lower carboxylic acid, preferably carbon dioxide) with a mixture comprising an acidic organic compound, a reaction medium comprising at least one inert, organic solvent (e.g., mineral oil, naphtha, toluene, xylene) for said acidic organic material, a stoichiometric excess of a metal base, and a promoter such as a phenol or alcohol and optionally ammonia. The acidic organic material will normally have a sufficient number of carbon atoms, for instance, as a hydrocarbyl substituent, to provide a reasonable degree of solubility in oil. The amount of excess metal is commonly expressed in terms of metal ratio. The term "metal ratio" is the ratio of the total equivalents of the metal to the equivalents of the acidic organic compound. A neutral metal salt has a metal ratio of one. A salt having 4.5 times as much metal as present in a normal salt will have metal excess of 3.5 equivalents, or a ratio of 4.5.

Overbased detergents are often characterized by Total Base Number (TBN). TBN is the amount of strong acid needed to neutralize all of the overbased material's basicity, expressed as potassium hydroxide equivalents (mg KOH per gram of sample). Since overbased detergents are commonly provided in a form which contains a certain amount of diluent oil, for example, 40-50% oil, the actual TBN value for such a detergent will depend on the amount of such diluent oil present, irrespective of the "inherent" basicity of the overbased material. For the purposes of the present invention, the TBN of an overbased detergent is presented on an oil-free basis, unless otherwise indicated. Detergents which are useful in the present invention may have a TBN (oil-free basis) of 50 or 100 to 800, and in one embodiment 150 to 750, and in another, 400 to 700.

The overall TBN of the composition, including oil, will be derived from the TBN contribution of the individual components, such as the dispersant, the detergent, and other basic materials. The overall TBN will typically be at least 3 or at least 4, sometimes 4 to 8 or 4.5 to 6. Sulfated ash (ASTM D-874) is another parameter often used to characterize such compositions. Certain of the compositions of the present invention can have sulfated ash levels of less than 0.8%, such as 0.3 to 0.75% or 0.4 to 0.7% or 0.45 to 0.6%

Overbased materials are well known to those skilled in the art. Patents describing techniques for making basic salts of sulfonic acids, carboxylic acids, (hydrocarbyl-substituted) phenols, phosphonic acids, and mixtures of any two or more of these include U.S. Pat. Nos. 2,501,731; 2,616,905; 2,616,911; 2,616,925; 2,777,874; 3,256,186; 3,384,585; 3,365,396; 3,320,162; 3,318,809; 3,488,284; and 3,629,109.

In one embodiment the lubricants of the present invention can contain an overbased sulfonate detergent. Suitable sulfonic acids include sulfonic and thiosulfonic acids. Sulfonic acids include the mono- or polynuclear aromatic or cycloaliphatic compounds. Oil-soluble sulfonates can be represented for the most part by one of the following formulas: $R^2$-T-$(SO_3—)_a$ and $R^3$—$(SO_3—)_b$, where T is a cyclic nucleus such as typically benzene or toluene; $R^2$ is an aliphatic group such as alkyl, alkenyl, alkoxy, or alkoxyalkyl; $(R^2)$-T typically contains a total of at least 15 carbon atoms; and $R^3$ is an aliphatic hydrocarbyl group typically containing at least 15 carbon atoms. Examples of $R^3$ are alkyl, alkenyl, alkoxyalkyl, and carboalkoxyalkyl groups. The groups T, $R^2$, and $R^3$ in the above formulas can also contain other inorganic or organic substituents In the above formulas, a and b are at least 1.

Another overbased material which can be present is an overbased phenate detergent. The phenols useful in making phenate detergents can be represented by the formula $(R^1)$—Ar—$(OH)_b$, wherein R1 is an aliphatic hydrocarbyl group of 4 to 400 carbon atoms, or 6 to 80 or 6 to 30 or 8 to 25 or 8 to 15 carbon atoms; Ar is an aromatic group (which can be a benzene group or another aromatic group such as naphthalene); a and b are independently numbers of at least one, the sum of a and b being in the range of two up to the number of displaceable hydrogens on the aromatic nucleus or nuclei of Ar. In one embodiment, a and b are independently numbers in the range of 1 to 4, or 1 to 2. $R^1$ and a are typically such that there is an average of at least 8 aliphatic carbon atoms provided by the $R^1$ groups for each phenol compound. Phenate detergents are also sometimes provided as sulfur-bridged species.

In one embodiment, the overbased material is an overbased saligenin detergent. Overbased saligenin detergents are commonly overbased magnesium salts which are based on saligenin derivatives. A general example of such a saligenin derivative can be represented by the formula

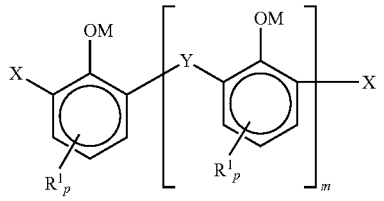

wherein X comprises —CHO or —$CH_2OH$, Y comprises —$CH_2$— or —$CH_2OCH_2$—, and wherein such —CHO groups typically comprise at least 10 mole percent of the X and Y groups; M is hydrogen, ammonium, or a valence of a metal ion (that is to say, in the case of a multivalent metal ion, one of the valences is satisfied by the illustrated structure and other valences are satisfied by other species such as anions, or by another instance of the same structure), $R^1$ is a hydrocarbyl group containing 1 to 60 carbon atoms, m is 0 to typically 10, and each p is independently 0, 1, 2, or 3, provided that at least one aromatic ring contains an $R^1$ substituent and that the total number of carbon atoms in all $R^1$ groups is at least 7. When m is 1 or greater, one of the X groups can be hydrogen. In one embodiment, M is a valence of a Mg ion or a mixture of Mg and hydrogen. Other metals include alkali metals such as lithium, sodium, or potassium; alkaline earth metals such as calcium or barium; and other metals such as copper, zinc, and tin. As used in this document, the expression "represented by the formula" indicates that the formula presented is generally representative of the structure of the chemical in question. However, it is well known that minor variations can occur, including in particular positional isomerization, that is, location of the X, Y, and R groups at different position on the aromatic ring from those shown in the structure. The expression "represented by the formula" as used throughout this document is expressly intended to encompass such variations. Saligenin detergents are disclosed in greater detail in U.S. Pat. No. 6,310,009, with special reference to their methods of synthesis (Column 8 and Example 1) and preferred amounts of the various species of X and Y (Column 6).

Salixarate detergents are overbased materials that can be represented by a substantially linear compound comprising at least one unit of formula (I) or formula (II):

(I)

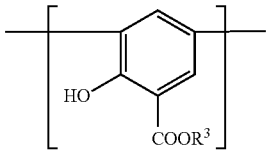

(II)

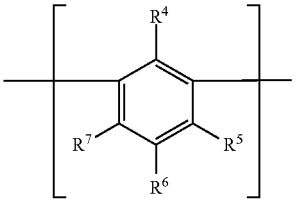

each end of the compound having a terminal group of formula (III) or (IV):

(III)

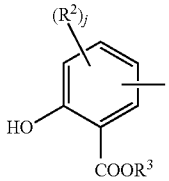

(IV)

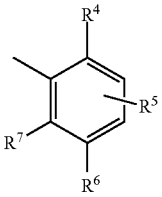

such groups being linked by divalent bridging groups A, which may be the same or different for each linkage; wherein in formulas (I)-(IV) $R^3$ is hydrogen or a hydrocarbyl group; $R^2$ is hydroxyl or a hydrocarbyl group and j is 0, 1, or 2; $R^6$ is hydrogen, a hydrocarbyl group, or a hetero-substituted hydrocarbyl group; either $R^4$ is hydroxyl and $R^5$ and $R^7$ are independently either hydrogen, a hydrocarbyl group, or hetero-substituted hydrocarbyl group, or else $R^5$ and $R^7$ are both hydroxyl and $R^4$ is hydrogen, a hydrocarbyl group, or a hetero-substituted hydrocarbyl group; provided that at least one of $R^4$, $R^5$, $R^6$ and $R^7$ is hydrocarbyl containing at least 8 carbon atoms; and wherein the molecules on average contain at least one of unit (1) or (III) and at least one of unit (II) or (IV) and the ratio of the total number of units (I) and (III) to the total number of units of (II) and (IV) in the composition is about 0.1:1 to about 2:1. The divalent bridging group "A," which may be the same or different in each occurrence, includes —$CH_2$— (methylene bridge) and —$CH_2OCH_2$— (ether bridge), either of which may be derived from formaldehyde or a formaldehyde equivalent (e.g., paraform, formalin).

Salixarate derivatives and methods of their preparation are described in greater detail in U.S. Pat. No. 6,200,936 and PCT Publication WO 01/56968. It is believed that the salixarate derivatives have a predominantly linear, rather than macrocyclic, structure, although both structures are intended to be encompassed by the term "salixarate."

Glyoxylate detergents are similar overbased materials which are based on an anionic group which, in one embodiment, may have the structure

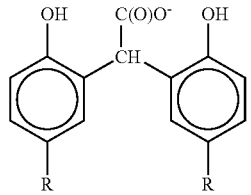

wherein each R is independently an alkyl group containing at least 4, and preferably at least 8 carbon atoms, provided that the total number of carbon atoms in all such R groups is at least 12, preferably at least 16 or 24. Alternatively, each R can be an olefin polymer substituent. The acidic material upon from which the overbased glyoxylate detergent is prepared is the condensation product of a hydroxyaromatic material such as a hydrocarbyl-substituted phenol with a carboxylic reactant such as glyoxylic acid and other omega-oxoalkanoic acids, Overbased glyoxylic detergents and their methods of preparation are disclosed in greater detail in U.S. Pat. No. 6,310,011 and references cited therein.

The overbased detergent can also be an overbased salicylate which may be an alkali metal salt or an alkaline earth metal salt of an alkylsalicylic acid. The salicylic acids may be hydrocarbyl-substituted salicylic acids wherein each substituent contains an average of at least 8 carbon atoms per substituent and 1 to 3 substituents per molecule. The substituents can be polyalkene substituents, where polyalkenes include homopolymers and interpolymers of polymerizable olefin monomers of 2 to 16, or 2 to 6, or 2 to 4 carbon atoms. The olefins may be monoolefins such as ethylene, propylene, 1-butene, isobutene, and 1-octene; or a polyolefinic monomer, such as diolefinic monomer, such 1,3-butadiene and isoprene. In one embodiment, the hydrocarbyl substituent group or groups on the salicylic acid contains 7 to 300 carbon atoms and can be an alkyl group having a molecular weight of 150 to 2000. The polyalkenes and polyalkyl groups are prepared by conventional procedures, and substitution of such groups onto salicylic acid can be effected by known methods, Alkyl salicylates may be prepared from an alkylphenol by Kolbe-Schmitt reaction; alternatively, calcium salicylate can be produced by direct neutralization of alkylphenol and subsequent carbonation. Overbased salicylate detergents and their methods of preparation are disclosed in U.S. Pat. Nos. 4,719,023 and 3,372,116.

Other overbased detergents can include overbased detergents having a Mannich base structure, as disclosed in U.S. Pat. No. 6,569,818.

One feature of the present invention is that a portion of the overbased metal detergents present is one or more overbased monovalent metal detergents. Suitable monovalent metals include Group I metals such as copper and the alkali metals, and notably lithium, sodium, and potassium. The amount of the overbased monovalent metal detergent (or detergents, if more than one such is present) will be sufficient to provide at least 0.01 weight percent monovalent metal, e.g., sodium, to the lubricant composition, based on the total weight of the lubricant. In certain embodiments the amount of monovalent metal (such as sodium) provided thereby may be 0.015 to 0.1 weight percent, or 0.02 to 0.06, or 0.023 to 0.05, or 0.01 to 0.05, or 0.025 to 0.045, or 0.029 to 0.04 weight percent. The monovalent metal supplied by the detergent should comprise at least 10 percent by weight of the total metal content of the lubricant composition, for instance, at least 12 or 13 or 15 percent, such as 10 to 30 percent or 1.5 to 30 percent or 18 to 29 percent, or 20 to 28 percent or 22 to 27 percent, (For this calculation, boron is not to be counted as a metal.) In other embodiments, the overbased monovalent metal detergent may contribute 10 to 30 weight percent of the metals contributed by all the detergents in the composition, or in other embodiments, 10 or 12 or 13 up to 30 percent or 15 to 30 percent or 18 to 29 percent, or 20 to 28 percent or 22 to 27 percent.

Similarly the overbased monovalent detergent will normally contribute at least 10 percent of the total sulfated ash of the composition (ASTM D 874, not excluding boron or other ash-forming materials), and in some embodiments at least 12 or 13 or 15 percent, such as 10 to 30 or 15 to 30 or 18 to 29 or 20 to 28 percent of the total sulfated ash. The overbased monovalent detergent may be a high TBN material of at least 400, 500, or 600 TBN units (calculated on an oil-free basis) and may exceed the TBN of the overbased divalent detergent (described in greater detail below) by a weight average TBN of at least 200 or 300 or even 400 units and optionally up to 600 TBN units. By weight average TBN, in this context, is meant that if more than one monovalent or divalent metal detergent is present, the TBN of each such category of detergent will be calculated as the weight average TBN of the individual components. Thus, for instance, a mixture of 1.6 g of a 100 TBN (measured) divalent metal detergent containing 50% oil and 50% active component, plus 1 g of a 200 TBN (measured) divalent metal detergent containing 30% oil and 70% active component, would correspond to a weight average, oil-free TBN of [(1.6 g×100)+(1 g×200)]/0.8 g+0.7 g) or 240 TBN.

Another portion of the overbased metal detergents present is one or more overbased divalent metal detergents. Suitable divalent detergents include alkaline earth metals such as magnesium, calcium, and barium, as well as other Group 2 metals such as zinc. In certain embodiments the monovalent metal is sodium and the divalent metal is calcium. The amount of the overbased divalent metal detergent be sufficient to provide at least about 0.005 percent by weight of the divalent metal to the lubricant composition, based on the total weight of the lubricant. In certain embodiments the amount of divalent metal provided thereby may be 0.05 to 0.5 weight percent, or 0.08 to 0.3 or 0.1 to 0.2 or 0.11 to 0.15 weight percent.

The overall amount of the overbased detergents, in the formulations of the present invention, is typically at least 0.6 weight percent on an oil-free basis. In other embodiments, they can be present in amounts of 0.7 to 5 weight percent or 0.8 to 3 weight percent. The amount of detergent may also be characterized in terms of the "soap content" contributed thereby. The "soap" portion of an overbased detergent is the acidic substrate component (e.g., the sulfonate, phenate, salicylate, or salixarate moiety), neutralized by one equivalent of metal, but excluding the excess metal and carbonate that are included by the overbasing process. On this basis, in certain embodiments, the lubricant employed has a soap content of at least 0.4 weight percent or 0.8 weight percent or 1.2 or 1.3 weight percent, and up to 2 percent 1.5 percent or 1.45 percent.

The present lubricant compositions will also contain a dispersant. Dispersants are well known in the field of lubricants and include primarily what is known as ashless dispersants and polymeric dispersants. Ashless dispersants are so-called because, as supplied, they do not contain metal and thus do not normally contribute to sulfated ash when added to a lubricant. However they may, of course, interact with ambient metals once they are added to a lubricant which includes metal-containing species. Ashless dispersants are characterized by a polar group attached to a relatively high molecular weight hydrocarbon chain. Typical ashless dispersants include N-substituted long chain alkenyl succinimides, having a variety of chemical structures including typically

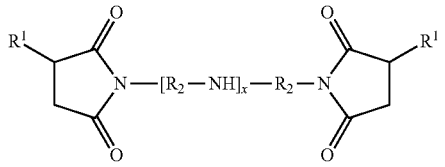

where each $R^1$ is independently a hydrocarbyl or an alkyl group, frequently a polyisobutylene group with a molecular weight of 500-5000, and $R^2$ are alkylene groups, commonly ethylene ($C_2H_4$) groups. Such molecules are commonly derived from reaction of an alkenyl acylating agent with a polyamine, and a wide variety of linkages between the two moieties is possible beside the simple imide structure shown above, including a variety of amides and amine salts. Certain of the products may be further alkylated to quaternary ammonium salts. Also, a variety of modes of linkage of the $R^1$ groups onto the imide structure are possible, including various cyclic linkages. The ratio of the carbonyl groups of the acylating agent to the nitrogen atoms of the amine may be 1:0.5 to 1:3, and in other instances 1:1 to 1:2.75 or 1:1.5 to 1:2.5. Succinimide dispersants are more fully described in U.S. Pat. Nos. 4,234,435 and 3,172,892 and in EP 0355895.

Another class of ashless dispersant is high molecular weight esters. These materials are similar to the above-described succinimides except that they may be seen as having been prepared by reaction of a hydrocarbyl acylating agent and a polyhydric aliphatic alcohol such as glycerol, pentaerythritol, or sorbitol. Such materials are described in more detail in U.S. Pat. No. 3,381,022.

Another class of ashless dispersant is Mannich bases. These are materials which are formed by the condensation of a higher molecular weight, alkyl substituted phenol, an alkylene polyamine, and an aldehyde such as formaldehyde. Such materials may have the general structure

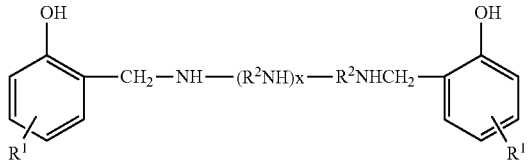

where n is 0 to, e.g., 10 (including a variety of isomers and the like) and are described in more detail in U.S. Pat. No. 3,634,515.

Other dispersants include polymeric dispersant additives, which are generally hydrocarbon-based polymers which contain polar functionality to impart dispersancy characteristics to the polymer.

Dispersants can also be post-treated by reaction with any of a variety of agents. Among these are urea, thiourea, dimercaptothiadiazoles, carbon disulfide, aldehydes, ketones, carboxylic acids, hydrocarbon-substituted succinic anhydrides, nitriles, epoxides, boron compounds, and phosphorus compounds. References detailing such treatment are listed in U.S. Pat. No. 4,654,403.

The present lubricant compositions will also contain a metal salt of a phosphorus acid. Metal salts of the formula

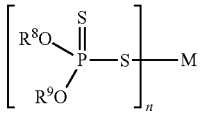

wherein $R^8$ and $R^9$ are independently hydrocarbyl groups containing 3 to 30 or to 20, to 16, or to 14 carbon atoms are readily obtainable by the reaction of phosphorus pentasulfide ($P_2S_5$) and an alcohol or phenol to form an O,O-dihydrocarbyl phosphorodithioic acid corresponding to the formula

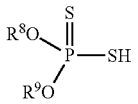

The reaction involves mixing at a temperature of 20° C. to 200° C., four moles of an alcohol or a phenol with one mole of phosphorus pentasulfide. Hydrogen sulfide is liberated in this reaction. The acid is then reacted with a basic metal compound to form the salt. The metal M, having a valence n, generally is aluminum, lead, tin, manganese, cobalt, nickel, zinc, or copper, and commonly zinc. The basic metal compound may thus be zinc oxide, and the resulting metal compound is represented by the formula

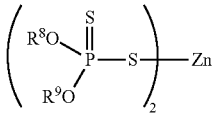

The $R^8$ and $R^9$ groups are independently hydrocarbyl groups that are typically free from acetylenic and usually also from ethylenic unsaturation. They are typically alkyl, cycloalkyl, aralkyl or alkaryl group and have 3 to 20 carbon atoms, such as 3 to 16 carbon atoms or up to 13 carbon atoms, e.g., 3 to 12 carbon atoms. The alcohol which reacts to provide the R8 and $R^9$ groups can be a mixture of a secondary alcohol and a primary alcohol, for instance, a mixture of 2-ethylhexanol and isopropanol or, alternatively, a mixture of secondary alcohols such as isopropanol and 4-methyl-2-pentanol.

Such materials are often referred to as zinc dialkyldithiophosphates or simply zinc dithiophosphates. They are well known and readily available to those skilled in the art of lubricant formulation.

The amount of the metal salt of a phosphorus acid in a completely formulated lubricant, if present, will typically be 0.1 to 4 percent by weight, preferably 0.5 to 2 percent by weight, and more preferably 0.75 to 1.25 percent by weight. Its concentration in a concentrate will be correspondingly increased, to, e.g., 5 to 20 weight percent. Nevertheless, the total phosphorus content (as P) of the lubricant, in certain embodiments, may be less than 0.1 percent by weight, for instance 0.015 to 0.08 percent or 0.02 to 0.06 percent or 0.025 to 0.05 percent or 0.03 to 0.4 percent or 0.01 to 0.05 percent or 0.02 to 0.04 percent.

Other lubricant additive components may also be included in the present lubricants. Such materials include viscosity modifiers. Most modern engine lubricants are multigrade lubricant which contain viscosity index improvers to provide suitable viscosity at both low and high temperatures. While the viscosity modifier is sometimes considered a part of the base oil, it is more properly considered as a separate component, the selection of which is within the abilities of the person skilled in the art. Viscosity modifiers generally are polymeric materials characterized as being hydrocarbon-based polymers generally having number average molecular weights between 25,000 and 500,000, e.g., between 50,000 and 200,000. Such materials may be used in, or they may be omitted from, lubricants designed for gas fueled engines.

Hydrocarbon polymers can be used as viscosity index improvers. Examples include homopolymers and copolymers of two or more monomers of C2 to C30, e.g., C2 to C8 olefins, including both alphaolefins and internal olefins, which may be straight or branched, aliphatic, aromatic, alkyl-aromatic, or cycloaliphatic. Examples include ethylene-propylene copolymers, generally referred to as OCPs, prepared by copolymerizing ethylene and propylene by known processes.

Hydrogenated styrene-conjugated diene copolymers are another class of viscosity modifiers. These polymers include polymers which are hydrogenated or partially hydrogenated homopolymers, and also include random, tapered, star, and block interpolymers. The term "styrene" includes various substituted styrenes. The conjugated diene may contain four to six carbon atoms and may include, e.g., piperylene, 2,3-dimethyl-1,3-butadiene, chloroprene, isoprene, and 1,3-butadiene. Mixtures of such conjugated dienes are useful. The styrene content of these copolymers may be 20% to 70% by weight or 40% to 60%, and the aliphatic conjugated diene content may be 30% to 80% or 40% to 60%. These copolymers can be prepared by methods well known in the art and are typically hydrogenated to remove a substantial portion of their olefinic double bonds.

Esters obtained by copolymerizing styrene and maleic anhydride in the presence of a free radical initiator and thereafter esterifying the copolymer with a mixture of C4-18 alcohols also are useful as viscosity modifying additives in motor oils. Likewise, polymethacrylates (PMA) are used as viscosity modifiers. These materials are typically prepared from mixtures of methacrylate monomers baying different alkyl groups, which may be either straight chain or branched chain groups containing 1 to 18 carbon atoms.

When a small amount of a nitrogen-containing monomer is copolymerized with alkyl methacrylates, dispersancy properties are incorporated into the product. Thus, such a product has the multiple function of viscosity modification, pour point depressancy and dispersancy and are sometimes referred to as dispersant-viscosity modifiers. Vinyl pyridine, N-vinyl pyrrolidone and N,N'-dimethylaminoethyl methacrylate are examples of nitrogen-containing monomers. Polyacrylates obtained from the polymerization or copolymerization of one or more alkyl acrylates also are useful as viscosity modifiers. Dispersant viscosity modifiers may also be interpolymers of ethylene and propylene which are grafted with an active monomer such as maleic anhydride and then derivatized with an alcohol or an amine or grafted with nitrogen compounds.

Another additive which may be present is an antioxidant. Antioxidants encompass phenolic antioxidants, which may be of the general the formula

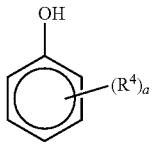

wherein $R^4$ is an alkyl group containing 1 to 24, or 4 to 18, carbon atoms and a is an integer of 1 to 5 or 1 to 3, or 2. The phenol may be a butyl substituted phenol containing 2 or 3 t-butyl groups, such as

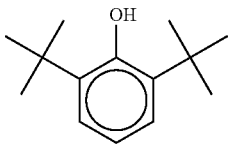

The para position may also be occupied by a hydrocarbyl group or a group bridging two aromatic rings. In certain embodiments the para position is occupied by an ester-containing group, forming a hindered phenolic ester antioxidant such as, for example, an antioxidant of the formula

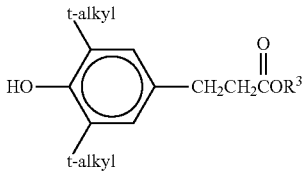

wherein $R^3$ is a hydrocarbyl group such as an alkyl group containing, e.g., 1 to 18 or 2 to 12 or 2 to 8 or 2 to 6 carbon atoms; and t-alkyl can be t-butyl. Such antioxidants are described in greater detail in U.S. Pat. No. 6,559,105. In certain embodiments the antioxidant component is a hindered phenolic antioxidant, and there is no or substantially no alkylene bridged phenolic antioxidant and/or no or substantially no aromatic amine antioxidant (described below).

Antioxidants also include aromatic amines, such as those of the formula

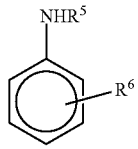

wherein $R^5$ can be an aromatic group such as a phenyl group, a naphthyl group, or a phenyl group substituted by $R^7$, and $R^6$ and $R^7$ can be independently a hydrogen or an alkyl group containing 1 to 24 or 4 to 20 or 6 to 12 carbon atoms. In one embodiment, an aromatic amine antioxidant can comprise an alkylated diphenylamine such as nonylated diphenylamine of the formula

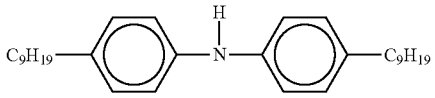

or a mixture of a di-nonylated diphenylamine and a mono-nonylated diphenylamine.

Antioxidants also include sulfurized olefins such as mono-, or disulfides or mixtures thereof. These materials generally have sulfide linkages having 1 to 10 sulfur atoms, for instance, 1 to 4, or 1 or 2. Materials which can be sulfurized to form the sulfurized organic compositions of the present invention include oils, fatty acids and esters, olefins and polyolefins made thereof, terpenes, or Diels-Alder adducts. Details of methods of preparing some such sulfurized materials can be found in U.S. Pat. Nos. 3,471,404 and 4,191,659.

Molybdenum compounds can also serve as antioxidants, and these materials can also serve in various other functions, such as antiwear agents. The use of molybdenum and sulfur containing compositions in lubricating oil compositions as antiwear agents and antioxidants is known, U.S. Pat. No. 4,285,822, for instance, discloses lubricating oil compositions containing a molybdenum and sulfur containing composition prepared by (1) combining a polar solvent, an acidic molybdenum compound and an oil-soluble basic nitrogen compound to form a molybdenum-containing complex and (2) contacting the complex with carbon disulfide to form the molybdenum and sulfur containing composition.

Typical amounts of antioxidants will, of course, depend on the specific antioxidant and its individual effectiveness, but illustrative total amounts can be 0.01 to 5 percent by weight or 0.15 to 4.5 percent or 0.2 to 4 percent.

Other conventional components may also be present, including pour point depressants; friction modifiers such as fatty esters; metal deactivators; rust inhibitors, high pressure additives, anti-wear additives, and antifoam agents. In one embodiment a rust inhibitor such as a hydroxy-containing ether or a tartrate or citrate ester may be present in an amount of 0.02 to 2 percent by weight. Tartaric acid derivatives may also be effective as one or more of antiwear agents, friction modifiers, antioxidants, and agents for improved seal performance.

The role of a corrosion inhibitor is to preferentially adsorb onto metal surfaces to provide protective film, or to neutralize corrosive acids. Examples of these include, but are not limited to ethoxylates, alkenyl succinic half ester acids, zinc dithiophosphates, metal phenolates, basic metal sulfonates, fatty acids and amines.

Anti-foam agents used to reduce or prevent the formation of stable foam include silicones or organic polymers. Examples of these and additional anti-foam compositions are described in "Foam Control Agents", by Henry T. Kerner (Noyes Data Corporation, 1976), pages 125-162.

Pour point depressants are used to improve the low temperature properties of oil-based compositions. See, for example, page 8 of "Lubricant Additives" by C. V. Smalheer and R. Kennedy Smith (Lezius Hiles Co. publishers, Cleveland, Ohio, 1967). Examples of useful pour point depressants are polymethacrylates; polyacrylates; polyacrylamides; condensation products of haloparaffin waxes and aromatic compounds; vinyl carboxylate polymers; and terpolymers of dialkylfumarates, vinyl esters of fatty acids and alkyl vinyl ethers. Pour point depressants are described in U.S. patents including U.S. Pat. No. 3,250,715.

Titanium compounds including soluble titanium-containing materials such as titanium isopropoxide, ethyhexyl titanate, and titanium-containing dispersants may also be used to impart an of a variety of beneficial properties such as deposit control, oxidation control, and improved filterability. Some such titanium materials are disclosed in greater detail in US patent publication 2006-0217271, Sep. 28, 2006.

Any one or more of the optional components can be present or can be eliminated, if desired.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy);

hetero substituents, that is, substituents which, while having a predominantly hydrocarbon character, in the context of this invention, contain other than carbon in a ring or chain otherwise composed of carbon atoms and encompass substituents as pyridyl, furyl, thienyl and imidazolyl. Heteroatoms include sulfur, oxygen, and nitrogen. In general, no more than two, preferably no more than one, non-hydrocarbon substituent will be present for every ten carbon atoms in the hydrocarbyl group; typically, there will be no non-hydrocarbon substituents in the hydrocarbyl group.

It is known that some of the materials described herein may interact in the final formulation, so that the components of the final formulation may be different from those that are initially added. For instance, metal ions (of, e.g., a detergent) can migrate to other acidic or anionic sites of other molecules. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

EXAMPLES

The following lubricant compositions are prepared. The amounts shown for the components are percent by weight:

| | Compar. Ex. 1 | Ex. 1 | Compar. Ex. 2 | Ex. 2 |
|---|---|---|---|---|
| Sodium sulfonate detergent, 448 TBN (including 31% diluent oil[a]) | 0 | 0.15 | 0 | 0.2 |
| Overbased calcium phenate and sulfonate detergents, containing 27-47% diluent oil[a] | 2.72 | 2.48 | 2.48 | 2.48 |
| Succinimide dispersant (incl. 40% oil) | 4.24 | 4.24 | 4.24 | 4.24 |
| Zinc dialkyldithiophosphate (9% oil) | 0.30 | 0.30 | 0.30 | 0.30 |
| Aromatic amine and/or hindered phenolic ester antioxidants | 2.35 | 2.35 | 1.5 | 1.5 |
| Sulfurized olefin | 0.5 | 0.5 | 0.5 | 0.5 |
| Substituted thiadiazole corrosion inhibitor | 0.06 | 0.06 | 0.06 | 0.06 |
| Borate ester | 0.35 | 0.35 | 0 | 0 |
| Antifoam agent (commercial) | 0.007 | 0.007 | 0.007 | 0.007 |
| Mineral Oil of Lubricating Viscosity | balance | balance | balance | balance |
| % Na | 0 | 0.029 | 0 | 0.039 |
| % Ca | 0.144 | 0.122 | 0.119 | 0.120 |
| % Zn | 0.034 | 0.034 | 0.034 | 0.034 |
| % Sulfated Ash (ASTM D 874) | 0.57 | 0.58 | 0.46 | 0.58 |
| % of the S'd Ash from Na sulfonate | 0 | 15 | 0 | 20 |
| % of the Detergent metal from Na sulfonate | 0 | 19 | 0 | 24 |
| TBN (ASTM D 2896, overall composition, oil-containing basis) | 5.7 | 6.0 | 4.8 | 5.9 |

[a]Both TBN and amount are reported on an oil-containing basis.

Thus Example 1 is substantially the same as Comparative Example 1 except that sodium sulfonate detergent is used to replace a certain amount of calcium sulfonate and calcium phenate detergents, at the same total sulfated ash content. Example 2 is the same as Comparative Example 2 except that the formulation has been top-treated with additional detergent in the form of sodium sulfonate.

The lubricant formulations thus prepared are subjected to a series of tests. A first test evaluates the nitration resistance of formulated crankcase oils. The oil to be evaluated is stressed by contacting it with air and nitric oxide for 22 hours, in the presence of an acid and a metal catalyst at 145° C. At the conclusion of the test the extent of nitration is determined by an infra-red spectroscopic method detecting the presence of a peak characteristic of nitration, $RONO_2$. Results are presented in terms of relative peak size. Corrosion resistance is evaluated by the HTCBT (High Temperature Corrosion Bench Test, ASTM D 6594), reporting amount of copper in the test fluid at the end of the test. TBN retention and TAN development are evaluated by the ISOT (Indiana Stirring Oxidation Test), in which an oil sample is placed in a beaker in the presence of an iron, a copper test coupon, and a glass varnish stick. The sample is stirred at 165° C. for 148 hours. In the same test, copper corrosion is evaluated by measuring the ppm Cu in the lubricant at the end of the test, and oxidative stability of the sample is evaluated in terms of % viscosity increase of the lubricant. The results of these tests are shown in the following Table:

| | Comp 1 | Ex 1 | Comp 2 | Ex. 2 |
|---|---|---|---|---|
| Nitration[b]($RONO_2$) | 13.9 | 8.1 | 11.4 | 5.9 |
| HTCBT corrosion, ppm Cu | 142 | 72 | 107 | 48 |
| ISOT, end of test values: | | | | |
| TAN (ASTM D 664A) | 4.13 | 2.31 | 3.68 | 1.70 |
| TBN (ASTM D 2896) | 0.4 | 1.7 | 1.5 | 2.2 |
| TBN (ASTM D 4739 | 0.5 | 1.1 | 0 | 1.4 |
| Cu, ppm | 293 | 66 | 159 | 50 |
| Viscosity increase (40° C.), % | 16.53 | 5.08 | 1.83 | −1.58 |

[b]Similar examination of IR peaks characteristic of carbonyl functionality, often associated with oxidation, did not demonstrate a consistent change.

In all the tests, the samples containing the sodium detergent show improved performance.

Each of the documents referred to above is incorporated herein by reference. The mention of any document is not an admission that such document qualifies as prior art or constitutes the general knowledge of the skilled person in any jurisdiction. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention can be used together with ranges or amounts for any of the other elements. As used herein, the expression "consisting essentially of" permits the inclusion of substances that do not materially affect the basic and novel characteristics of the composition under consideration.

What is claimed is:

1. A method for lubricating an engine fueled by natural gas, comprising adding thereto a lubricant composition comprising:

(a) an oil of lubricating viscosity, (b) an overbased sodium sulfonate detergent in an amount to provide 0.015 to 0.1 weight percent sodium to the lubricant composition, wherein the sodium comprises about 10 to 27 percent by weight of the total metal content of the lubricant composition, (c) an overbased calcium detergent, in an amount to provide 0.05 to 0.3 percent by weight of calcium to the lubricant composition, (d) a succinimide dispersant, and (e) a zinc salt of a phosphorus acid;

wherein the lubricant composition has a sulfated ash of 0.3 to less than about 0.8 percent and wherein the overbased sodium sulfonate detergent contributes about 15 to about 30 percent of the total sulfated ash of the composition.

2. The method of claim 1 wherein the natural gas is compressed natural gas.

3. The method of claim 1 wherein the weight average total base number of the one or more overbased sodium detergents is at least 200 units higher than the weight average total base number of the one or more overbased calcium detergents, each calculated on an active chemical basis.

4. The method of claim 1 wherein the zinc salt of a phosphorus acid is a zinc dialkyldithiophosphate.

5. The method of claim 1 wherein the lubricant composition further comprises a hindered phenolic ester antioxidant.

6. The method of claim 1 wherein the lubricant composition has a phosphorus content of less than about 0.1 percent by weight.

7. The method of claim 1 wherein the lubricant composition has a phosphorus content of about 0.01 to about 0.05 weight percent.

8. The method of claim 1 wherein the lubricant composition is the composition formed by admixing components (a) through (e).

9. The method of claim 1 wherein the TBN of the overbased sodium sulfonate detergent is at least about 400.

10. The method of claim 1 wherein the sodium comprises about 15 to 27 percent by weight of the total metal content of the lubricant composition.

11. In a method for lubricating an engine fueled by natural gas, comprising adding thereto a lubricant composition comprising:

an oil of lubricating viscosity;

an overbased detergent;

a succinimide dispersant; and a zinc salt of a phosphorus acid, the improvement comprising:

using as the overbased detergent a combination of (b) an overbased sodium sulfonate detergent in an amount to provide 0.015 to 0.1 weight percent sodium to the lubricant composition, wherein the sodium comprises about 10 to 27 percent by weight of the total metal content of the lubricant composition, and (c) an overbased calcium detergent, in an amount to provide percent by weight of calcium to the lubricant composition, wherein the lubricant composition has a sulfated ash of 0.3 to less than about 0.8 percent and wherein the overbased sodium detergent contributes about 15 to about 30 percent of the total sulfated ash of the composition.

* * * * *